US009640336B2

(12) United States Patent
Zhong et al.

(10) Patent No.: US 9,640,336 B2
(45) Date of Patent: May 2, 2017

(54) MAGNETIC LATCHING RELAY HAVING ASYMMETRICAL SOLENOID STRUCTURE

(71) Applicant: Xiamen Hongfa Electric Power Controls Co., Ltd., Xiamen, Fujian (CN)

(72) Inventors: Shuming Zhong, Fujian (CN); Libin Rao, Fujian (CN)

(73) Assignee: Xiamen Hongfa Electric Power Controls Co., Ltd., Xiamen, Fujian (CN)

( * ) Notice: Subject to any disclaimer, the term of this patent is extended or adjusted under 35 U.S.C. 154(b) by 0 days.

(21) Appl. No.: 14/780,035

(22) PCT Filed: Jan. 29, 2014

(86) PCT No.: PCT/CN2014/071724
§ 371 (c)(1),
(2) Date: Sep. 25, 2015

(87) PCT Pub. No.: WO2014/154056
PCT Pub. Date: Oct. 2, 2014

(65) Prior Publication Data

US 2016/0035502 A1 Feb. 4, 2016

(30) Foreign Application Priority Data

Mar. 29, 2013 (CN) ..... 2013 1 0109691

(51) Int. Cl.
*H01H 9/00* (2006.01)
*H01H 1/54* (2006.01)
(Continued)

(52) U.S. Cl.
CPC ..... *H01H 1/54* (2013.01); *H01F 7/122* (2013.01); *H01H 50/42* (2013.01);
(Continued)

(58) Field of Classification Search
CPC ..... H01H 1/54; H01F 7/08; F16K 31/02
(Continued)

(56) References Cited

U.S. PATENT DOCUMENTS 2,467,720 A * 4/1949 Austin ..... H01H 83/08 200/508
2,848,579 A * 8/1958 Russell ..... H01H 51/2236 335/179
(Continued)

FOREIGN PATENT DOCUMENTS

CN 2485779 Y 4/2002
CN 1366312 A 8/2002
(Continued)

OTHER PUBLICATIONS

International Search Report for corresponding International Application No. PCT/CN2014/071724 dated Jul. 2, 2014.
(Continued)

*Primary Examiner* — Shawki S Ismail
*Assistant Examiner* — Lisa Homza
(74) *Attorney, Agent, or Firm* — Renner, Otto, Boisselle & Sklar, LLP

(57) ABSTRACT

Disclosed is a magnetic latching relay having an asymmetrical solenoid structure, the magnetic latching relay comprising an electromagnet portion, a contacting portion, and a drive portion; the electromagnet portion comprises a magnetic conductive component, a coil rack, and a coil; the drive portion comprises a movable iron core; further comprising two pieces of permanent magnet, the two magnets being respectively disposed on the two sides of a coil axis and being respectively adjacent to or in contact with the corresponding sides of the magnetic conductive component; and the two pieces of permanent magnets are within the movement range of the movable iron core in the axial direction of
(Continued)

the coil, and are biased towards the moving direction of the movable iron core when a contact is in the closed state, such that the retaining force of the moving iron core is substantially the same in both closed and open states of contact. The present invention introduces biased permanent magnets into a relay having a solenoid electromagnet portion structure to make the relay a magnetic latching relay, for ensuring low heat dissipation while solving the problem of unbalanced action reset voltage of a solenoid electromagnet portion, thus improving product performance and operational reliability.

6 Claims, 9 Drawing Sheets

(51) Int. Cl.
*H01H 51/27* (2006.01)
*H01H 50/42* (2006.01)
*H01H 51/22* (2006.01)
*H01F 7/122* (2006.01)
*H01H 50/54* (2006.01)

(52) U.S. Cl.
CPC ..... *H01H 51/2209* (2013.01); *H01H 51/27* (2013.01); *H01H 50/546* (2013.01)

(58) Field of Classification Search
USPC ..... 335/177
See application file for complete search history.

(56) References Cited

U.S. PATENT DOCUMENTS 2,919,324 A * 12/1959 Schuessler ..... H01H 51/12 335/126
3,634,735 A * 1/1972 Komatsu ..... H01F 7/1646 335/234
3,848,206 A * 11/1974 Prouty ..... H01H 50/305 200/286
3,984,795 A * 10/1976 Gaskill ..... H01H 51/2209 335/170
4,306,207 A * 12/1981 Tada ..... H01F 7/1615 335/229
4,316,167 A * 2/1982 Koehler ..... H01F 7/08 335/229
4,419,643 A * 12/1983 Ojima ..... H01F 7/1615 335/230
4,422,060 A * 12/1983 Matsumoto ..... H01F 7/13 335/234
4,509,025 A * 4/1985 Kimpel ..... H01H 51/2245 335/79
4,635,016 A * 1/1987 Guery ..... H01F 7/1646 335/230
4,644,311 A * 2/1987 Guery ..... H01H 51/2209 335/230
4,746,886 A * 5/1988 Uetsuhara ..... H01H 51/2209 335/230
4,797,645 A 1/1989 Uetsuhara
4,859,975 A * 8/1989 Uetsuhara ..... H01H 51/2209 335/230
4,994,776 A * 2/1991 Juncu ..... H01F 7/1646 335/230
5,010,911 A * 4/1991 Grant ..... F16K 31/082 137/68.3
5,272,458 A * 12/1993 Hoffman ..... H01H 51/2209 335/179
5,883,557 A * 3/1999 Pawlak ..... H01H 51/2209 335/177
5,959,519 A * 9/1999 Gobel ..... H01F 7/1615 335/132
6,040,752 A * 3/2000 Fisher ..... H01F 7/1615 335/229
6,265,956 B1 * 7/2001 Cascolan ..... H01F 7/1615 335/234
6,707,358 B1 3/2004 Massman
6,816,048 B2 * 11/2004 Morita ..... H01F 7/1615 218/154
6,876,284 B2 * 4/2005 Wright ..... H01F 7/066 335/229
7,352,268 B2 * 4/2008 Wright ..... H01F 7/0242 335/229
7,605,680 B2 * 10/2009 Matsumoto ..... H01F 7/081 335/103
7,893,802 B2 * 2/2011 Fortsch ..... H01F 7/13 200/318
9,305,730 B2 * 4/2016 Sasaki ..... H01H 51/2209
2004/0066261 A1 4/2004 Nishida et al.
2009/0167470 A1 * 7/2009 Cusicanqui ..... H01H 51/2209 335/170
2013/0301181 A1 * 11/2013 Naka ..... H01H 9/443 361/194
2016/0172137 A1 * 6/2016 Liang ..... H01H 50/16 335/179

FOREIGN PATENT DOCUMENTS

CN 201859815 U 6/2011
CN 201898088 U 7/2011
CN 103236376 A 8/2013
CN 203134717 U 8/2013
JP 1982-186312 A 11/1982
JP S60-123005 A 7/1985
JP S61-064105 A 4/1986
JP 2007-059460 A 3/2007
JP 2010-010057 A 1/2010
JP 2012-104361 A 5/2012
KR 2013-0029584 A 3/2013
WO 2012157170 A1 11/2012

OTHER PUBLICATIONS

Extended European Search Report for corresponding Application No. 14776269.4 dated Oct. 31, 2016.
Office Action received in corresponding Japanese Application No. 2016-504461 dated Oct. 4, 2016.
Office Action received in corresponding Korean Application No. 10-2015-7028134 dated Sep. 29, 2016.

* cited by examiner

Fig. 1 - Prior Art

MAGNETIC LATCHING RELAY HAVING ASYMMETRICAL SOLENOID STRUCTURE

CROSS-REFERENCE TO RELATED APPLICATIONS

This application claims priority under 35 U.S.C. §119 to Chinese Patent Application No. 201310109691.4, filed on Mar. 29, 2013, the entire contents of which are incorporated herein by reference.

TECHNICAL FIELD

The present disclosure relates to a magnetic latching relay, and more particularly, to a magnetic latching relay having an asymmetrical solenoid structure.

BACKGROUND

A magnetic latching relay is a new type of relay and also a type of automatic switch developed in recent years. Similar to other electromagnetic relays, the magnetic latching relay functions to automatically switch on and off a circuit. The difference lies in that, the magnetic latching relay is a type of bi-stable relay which remains in an excited state after energizing quantity is removed.

An electromagnetic relay having a solenoid magnetic structure is one type of a relay, and in the related art, the electromagnetic relay having a solenoid magnetic structure includes, as shown in FIG. 1, an electromagnet portion, a contacting portion, a push portion and a housing 100. The electromagnet portion, the contacting portion and the push portion are respectively accommodated within the housing 100. The contacting portion includes a movable spring portion and a fixed spring portion. The movable spring portion is composed of a movable spring leaf 101 and a movable contact 102. The fixed spring portion is composed of a fixed spring leaf 103 and a stationary contact 104. The movable contact 102 and the stationary contact 104 are disposed to be fitted with each other, such that when the relay is actuated, the movable contact 102 of the movable spring portion and the stationary contact 104 of the fixed spring portion can contact each other. The electromagnet portion includes a magnetic conductive component, a coil rack (not shown in the Figure), and a coil 105. The magnetic conductive component includes a U-shaped yoke 106, a yoke plate 107 and a fixed iron core 108. The fixed iron core 108 is mounted in the coil rack, the U-shaped yoke 106 and the yoke plate 107 are connected to form a frame shape and to accommodate the fixed iron core 108 and the coil 105 therein. The push portion includes a movable iron core 109, a push rod 110 and a holder 111. The movable spring portion is mounted on the holder 111 and fitted with a compression spring 112, to enable an over stroke when the relay is actuated. The movable iron core 109 is disposed within the frame formed by the U-shaped yoke 106 connected with the yoke plate 107, and is fitted with the fixed iron core 108. One end of the push rod 110 is fixed with the movable iron core 109, and the other end of the push rod 110 is connected with the holder 111. The actuation and release of such a relay is realized through attraction forces generated by the coil 105. Positive or negative pulse voltages are applied to the coil 105 to drive the movement of the movable iron core 109, bring together or separate the movable spring portion and the fixed spring portion via the push rod 110, thereby to realize the automatic switching function. For example, when the relay is actuated, the coil 105 generates a large attraction force to allow the movable iron core 109 to move in an axial direction, thereby to cause the push portion to close the relay. When the voltage on the coil 105 is decreased, the attraction force generated by the coil 105 allows the contacts of the relay to be remained in a closed state. Such a relay having a solenoid magnetic structure generates a counter force in a closing direction unbalanced with a counter force in an opening direction, with the closing counter force generally being greater than the opening counter force, resulting in an actuation voltage unbalanced with a reset voltage.

SUMMARY OF THE INVENTION

The technical solution to the technical problem of the present disclosure is: a magnetic latching relay having an asymmetrical solenoid structure, including an electromagnet portion, a contacting portion, and a push portion; the push portion being fitted between the electromagnet portion and the contacting portion; the push portion including a movable iron core; the electromagnet portion including a magnetic conductive component, a coil rack, and a coil; the movable iron core being disposed to be fitted with the magnetic conductive component and movable along a direction of an axis of the coil upon excitation of the coil; the magnetic latching relay further includes two pieces of permanent magnet, the two pieces of permanent magnets being respectively disposed on two sides of the axis of the coil and being respectively adjacent to or in contact with corresponding sides of the magnetic conductive component; and the two pieces of permanent magnets being within a movement range of the movable iron core in the direction of the axis of the coil, and being biased toward a side of a moving direction of the movable iron core when contacts are in a closed state such that a retaining force of the movable iron core in the closed state of the contacts is substantially equal to a retaining force of the movable iron core in an opened state of the contacts.

The magnetic conductive component includes a yoke component, and a first fixed iron core mounted in the coil rack; the movable iron core is disposed to be fitted with the first fixed iron core; and the two pieces of permanent magnets are respectively disposed on the two sides of the axis of the coil and are respectively adjacent to or in contact with corresponding sides of the yoke component.

The magnetic conductive component further includes a second fixed iron core disposed on the axis of the coil and on the side of the moving direction of the movable iron core when the contacts are in the closed state; the movable iron core is disposed between the first fixed iron core and the second fixed iron core; and the two pieces of permanent magnets are disposed closer to the second fixed iron core in the direction of the axis of the coil.

The first fixed iron core has a length greater than a length of the second fixed iron core.

The second fixed iron core has a cross sectional range greater than a cross sectional range of the movable iron core.

The yoke component is in a frame shape, and the coil rack, the coil, the permanent magnet, the first fixed iron core and the second fixed iron core are respectively accommodated in the frame shape of the yoke component.

Permanent magnet slots are respectively disposed on two sides of the upper end of the coil rack, and the two pieces of permanent magnets are respectively fixed in the permanent magnet slots of the coil rack.

The permanent magnet slots of the coil rack and an outlet terminal of the coil are disposed on the same end of the coil rack.

The push portion further includes a push rod and a holder, a movable spring portion is mounted on the holder, one end of the push rod passes through the yoke component and the second fixed iron core to be fixed with the movable iron core, and the other end of the push rod is connected to the holder.

A boss for supporting a movable spring leaf and a compression spring is disposed on the holder, such that the movable spring leaf is supported through a preload of the compression spring and is allowed to be displaced and produce an over stroke in the direction of the axis of the coil.

The yoke component is composed of a U-shaped yoke and a yoke plate. The yoke plate is connected to the upper end of the U-shaped yoke to form a frame shape.

In the magnetic latching relay having an asymmetrical solenoid structure according to an embodiment of the present disclosure, asymmetrical permanent magnets are provided in the relay having an asymmetrical solenoid structure, such that the relay becomes a magnetic latching relay. The permanent magnets are disposed asymmetrically, such that the relay can generate unbalanced magnetic forces in the actuating direction and in the opening direction. Since the permanent magnets are within a movement range of the movable iron core in the direction of the axis of the coil, and is biased toward a side of a moving direction of the movable iron core when the contacts are in a closed state, that is, the permanent magnets are closer to the second fixed iron core, the magnetic force generated in the closed position by the permanent magnets is generally larger than the magnetic force generated in the opened position. Of the above mentioned unbalanced counter forces generated by the solenoid electromagnet portion, the counter force in the closed state is also larger than the counter force in the opened state. Since the retaining force=$F_{magnetic}-F_{counter}$, it is ensured that the retaining forces keep balanced in the actuation process and in the reset process.

Hereinafter, the present disclosure is further described in detail with reference to the accompanying drawings and the embodiments. However, the magnetic latching relay having an asymmetrical solenoid structure according to an embodiment of the present disclosure is not limited to the embodiments.

DETAILED DESCRIPTION OF THE INVENTION

Embodiments

Figure 1:
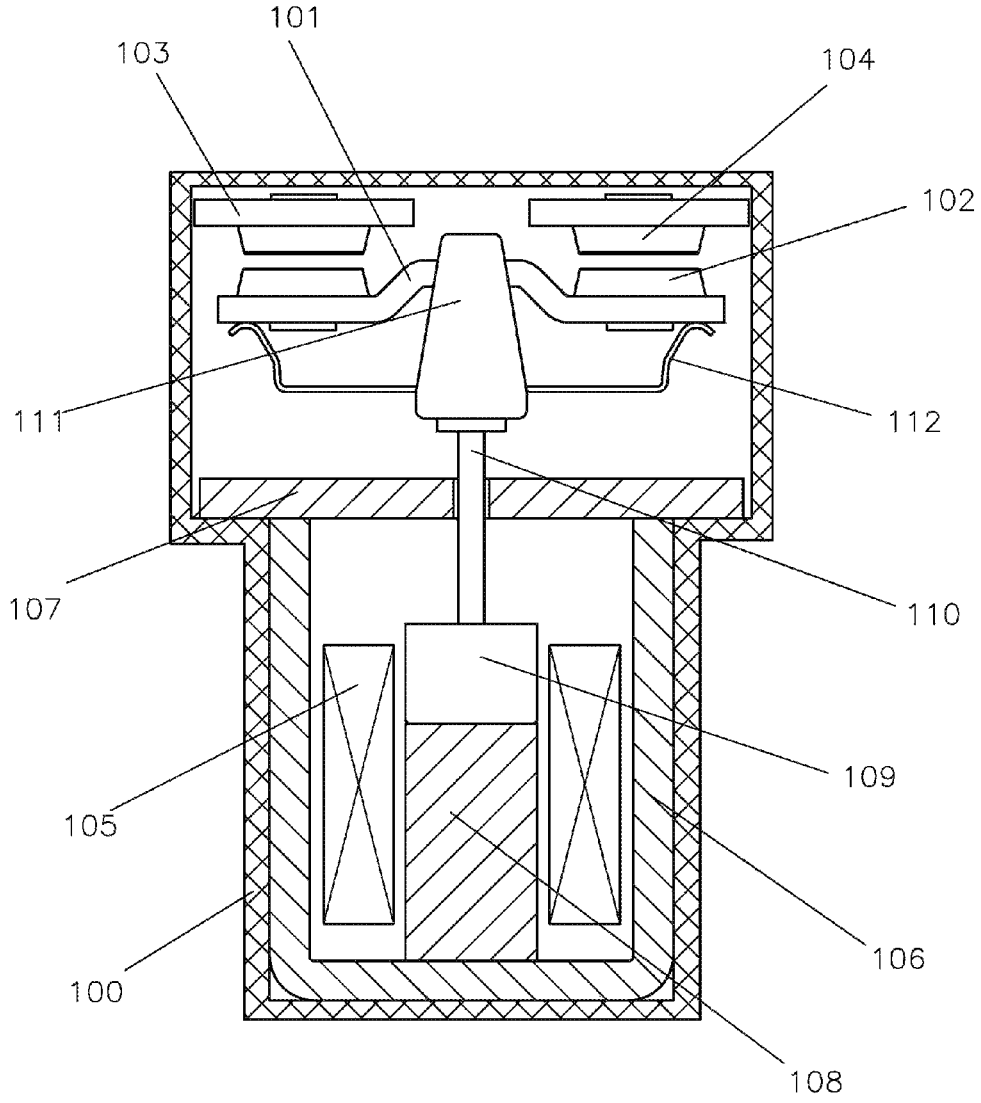
FIG. 1 is a schematic structural diagram of an electromagnetic relay having a solenoid magnetic structure according to the related art.
Figure 2:
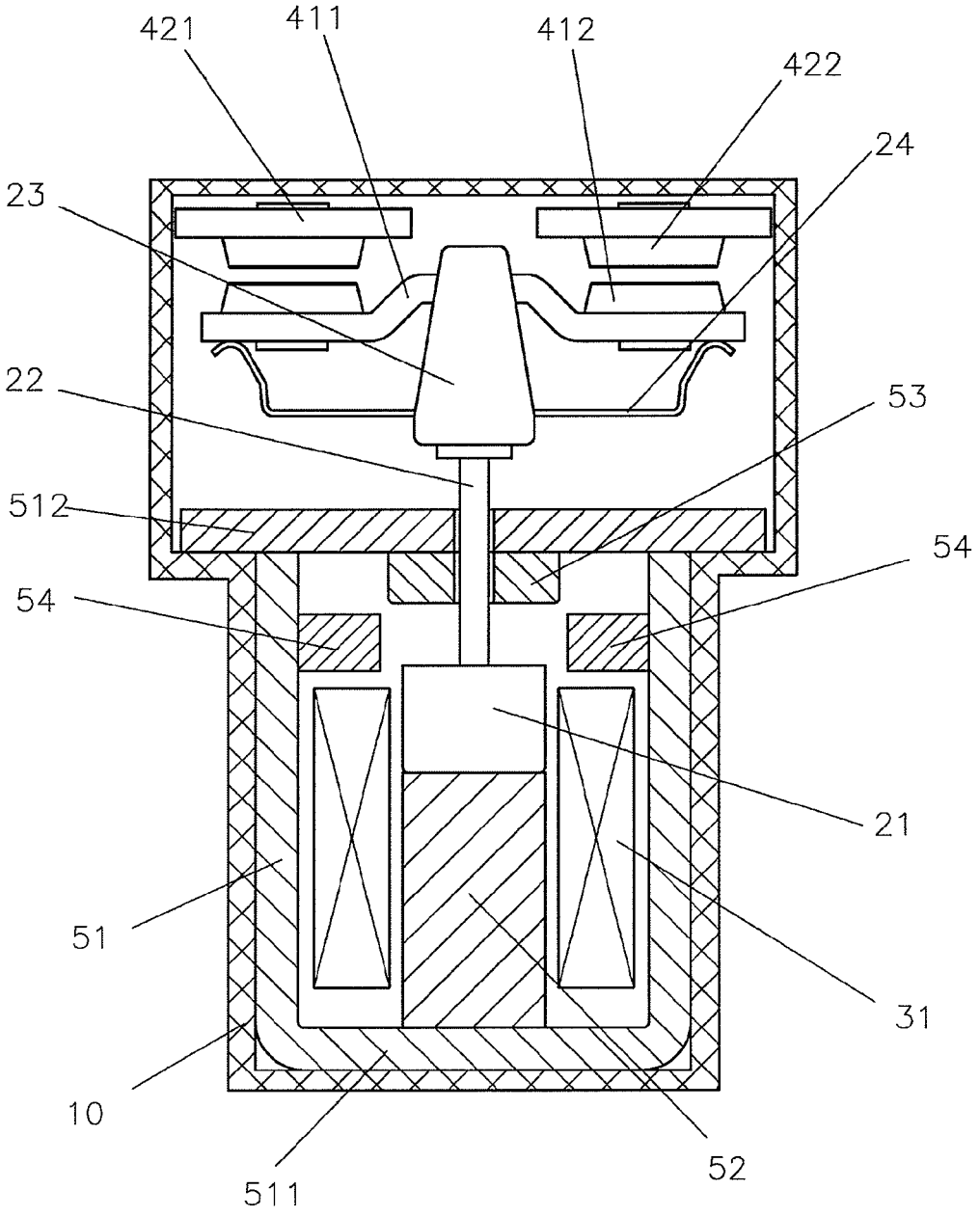
FIG. 2 is a schematic structural diagram of a magnetic latching relay having an asymmetrical solenoid structure according to an embodiment of the present disclosure.

Referring to FIGS. 2 to 9, a magnetic latching relay having an asymmetrical solenoid structure according to an embodiment of the present disclosure includes an electromagnet portion, a contacting portion, a push portion and a housing 10. The electromagnet portion, the contacting portion and the push portion are respectively accommodated within the housing 10, and the push portion is fitted between the electromagnet portion and the contacting portion. The push portion includes a movable iron core 21. The electromagnet portion includes a magnetic conductive component, a coil rack (not shown in the Figures), and a coil 31. The contacting portion includes a movable spring portion and a fixed spring portion. The movable spring portion is composed of a movable spring leaf 411 and a movable contact 412. The fixed spring portion is composed of a fixed spring leaf 421 and a stationary contact 422. The movable contact 412 and the stationary contact 422 are disposed to be fitted with each other, such that when the relay is actuated, the movable contact 412 of the movable spring portion and the stationary contact 422 of the fixed spring portion can contact each other. The magnetic conductive component includes a frame-shaped yoke component 51, and a first fixed iron core 52 mounted in the coil rack. The magnetic conductive component also includes a second fixed iron core 53. The magnetic latching relay also includes two pieces of permanent magnets 54. The second fixed iron core 53 is disposed in the yoke component at a position closer to the contacting portion than the position of the first fixed iron core 52, and the second fixed iron core 53 is on an axis of the coil 31. The two pieces of the permanent magnets 54 are respectively disposed on two sides of the axis of the coil. One piece of the permanent magnets 54 is adjacent to or in contact with one side portion of the yoke component, and the other piece of permanent magnets 54 is adjacent to or in contact with the other side portion of the yoke component. The two pieces of the permanent magnets 54 are within a movement range of the movable iron core 21 in the direction of the axis of the coil 31, and is biased toward a side of a moving direction of the movable iron core 21 when contacts are in a closed state. That is, the two pieces of the permanent magnets 54 are on the direction of the axis of the coil, and more biased toward the second fixed iron core 53 than toward the first fixed iron core 52, such that a retaining force of the movable iron core 21 in the closed state of the contacts is substantially equal to a retaining force of the movable iron core 21 in the opened state of the contacts.

The first fixed iron core 52 has a length greater than a length of the second fixed iron core 53. The length herein refers to a length in the direction of the axis of the coil 31.

The second fixed iron core 53 has a cross sectional range (i.e. a cross sectional area) greater than a cross sectional range of the movable iron core 21.

Permanent magnet slots are respectively disposed on two sides of the upper end of the coil rack, and the two pieces of permanent magnets 54 are respectively fixed in the permanent magnet slots of the coil rack.

The permanent magnet slots of the coil rack and an outlet terminal of the coil are disposed on the same end of the coil rack.

The push portion also includes a push rod 22 and a holder 23, the movable spring portion is mounted on the holder 23. One end of the push rod 22 passes through the yoke component and the second fixed iron core 53 to be fixed with the movable iron core 21. The other end of the push rod 22 is connected to the holder 23.

A boss for supporting the movable spring leaf 411 and the compression spring 24 is disposed on the holder 23, such that the movable spring leaf 411 is supported through a preload of the compression spring 24 and is allowed to be displaced and produce an over stroke in the direction of the axis of the coil 31.

The yoke component 51 is composed of a U-shaped yoke 511 and a yoke plate 512. The yoke plate 512 is connected to the upper end of the U-shaped yoke 511 to form a frame shape.

Figure 3:
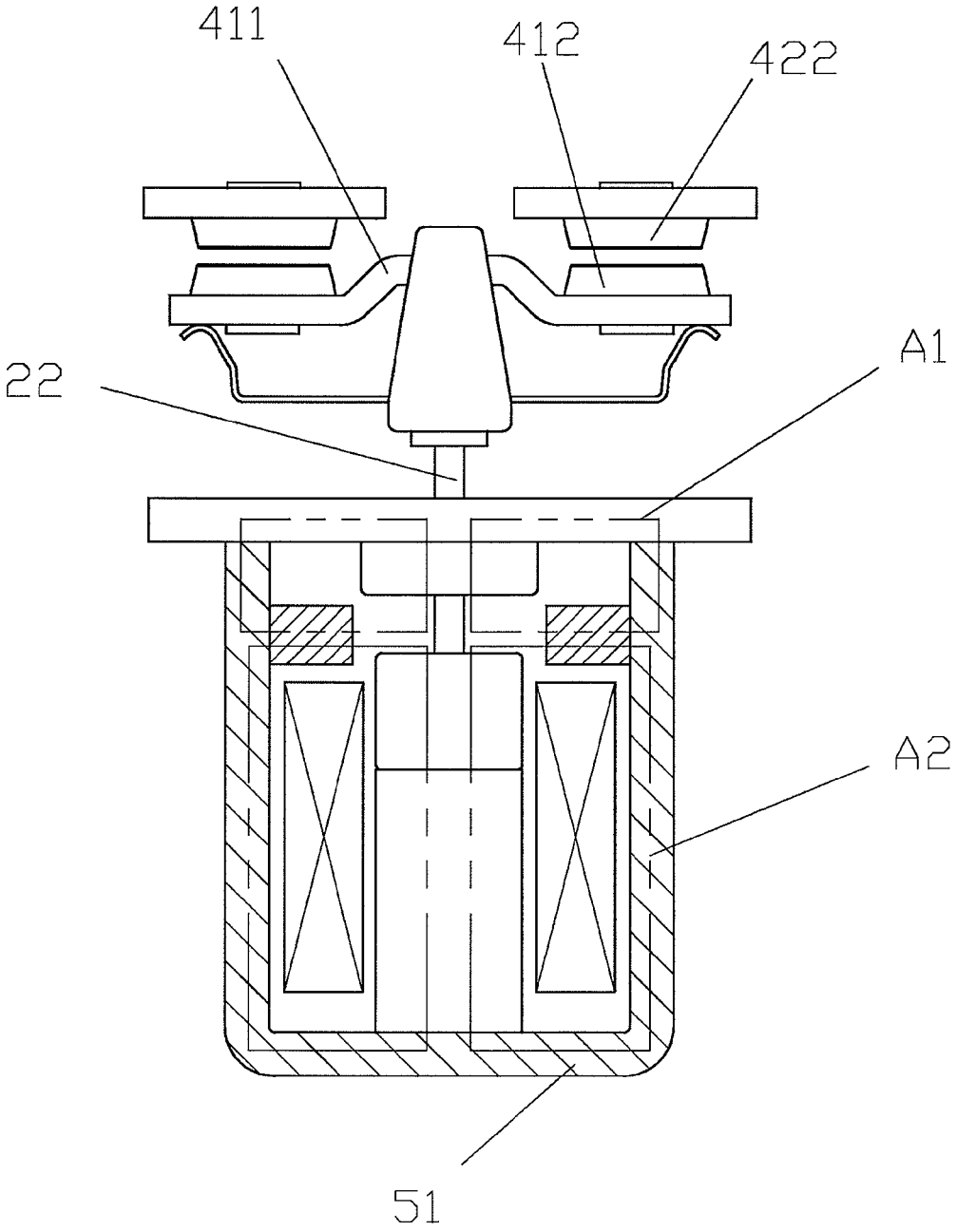
FIG. 3 is a schematic diagram showing an electromagnet portion of permanent magnets in a magnetic latching relay having an asymmetrical solenoid structure according to an embodiment of the present disclosure.

The magnetic latching relay having an asymmetrical solenoid structure according to an embodiment of the present disclosure is characterized in that the permanent magnets 54 are closer to the second fixed iron core 53 in the direction of the axis of the coil 31, and the length of the first fixed iron core 52 is greater than, even much greater than, the length of the second fixed iron core 53, such that the electromagnet portion of the entire magnetic structure is asymmetrical. As shown in FIG. 3, an upper electromagnet portion A1 is relatively shorter, and a lower electromagnet portion A2 is relatively longer. Based on electromagnet portion theory, the longer the electromagnet portion is, the larger the magnetic loss is, and the smaller the attraction force is. Accordingly, the permanent magnets 54 generate a magnetic force at a contacting position of the movable iron core 21 and the second fixed iron core 53 greater than a magnetic force generated at a contacting position of the movable iron core 21 and the first fixed iron core 52 (presuming that the areas of the opposing magnetic poles are the same).

In the structure shown in FIG. 3, generally, the movable iron core 21 moves up and down, which makes the push rod 22 to slide up and down. Since an upper end of the push rod 22 is connected to the holder 23, holes have to be provided penetrating the movable iron core 21 and the second fixed iron core 53 to assemble the push rod 22. This reduces the area of the opposing magnetic poles on the surface of the movable iron core. That is, the area of the opposing magnetic poles between the second fixed iron core 53 and the movable iron core 21 is smaller than the area of the opposing magnetic poles between the first fixed iron core 52 and the movable iron core 21. According to a formula of attraction force $F=K*\phi*s$, the attraction force is in proportion to the area of the opposing magnetic poles. Thus, in such a structure, the same coil 31 can generate an attraction force of a different magnitude in a closed position compared with that in an opened position. In the present disclosure, the length of the first fixed iron core 52 is designed to be greater than the length of the second fixed iron core 53, to balance the difference between the areas of the opposing magnetic poles.

In addition, in the present disclosure, the movable iron core 21 is designed to be smaller than the movable iron core in the related art, to reduce the weight of the movable iron core 21. Thus, the size of the permanent magnets 54 may be relatively reduced, to ensure that when the contacts are closed, the permanent magnets 54 have a sufficient magnetic force to remain the movable iron core 21 at a position contacting with the second fixed iron core 53.

Figure 4:
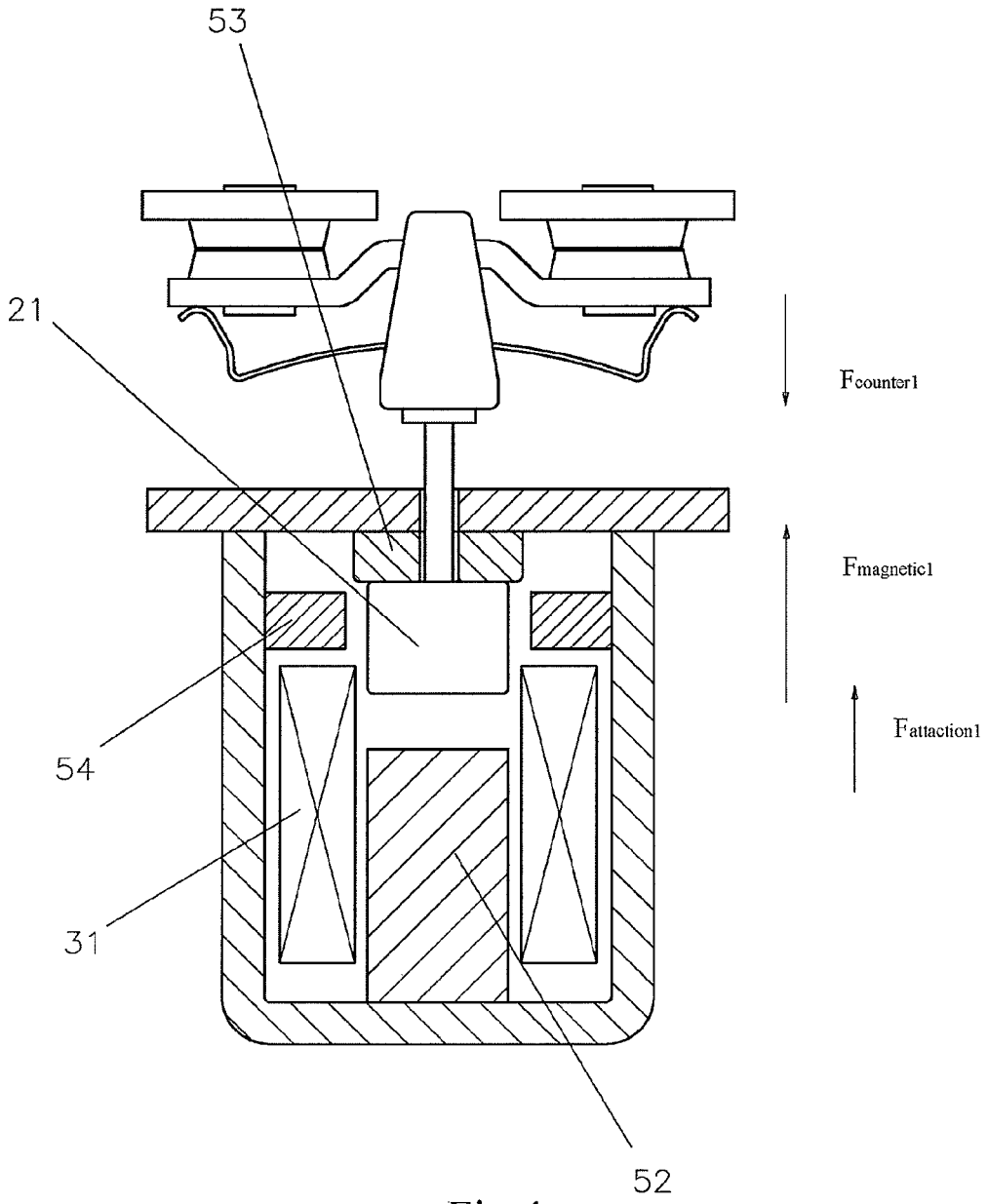
FIG. 4 is a schematic diagram showing a magnetic force, a coil attraction force and a counter force (in a contact closed state) of a magnetic latching relay having an asymmetrical solenoid structure according to an embodiment of the present disclosure.
Figure 5:
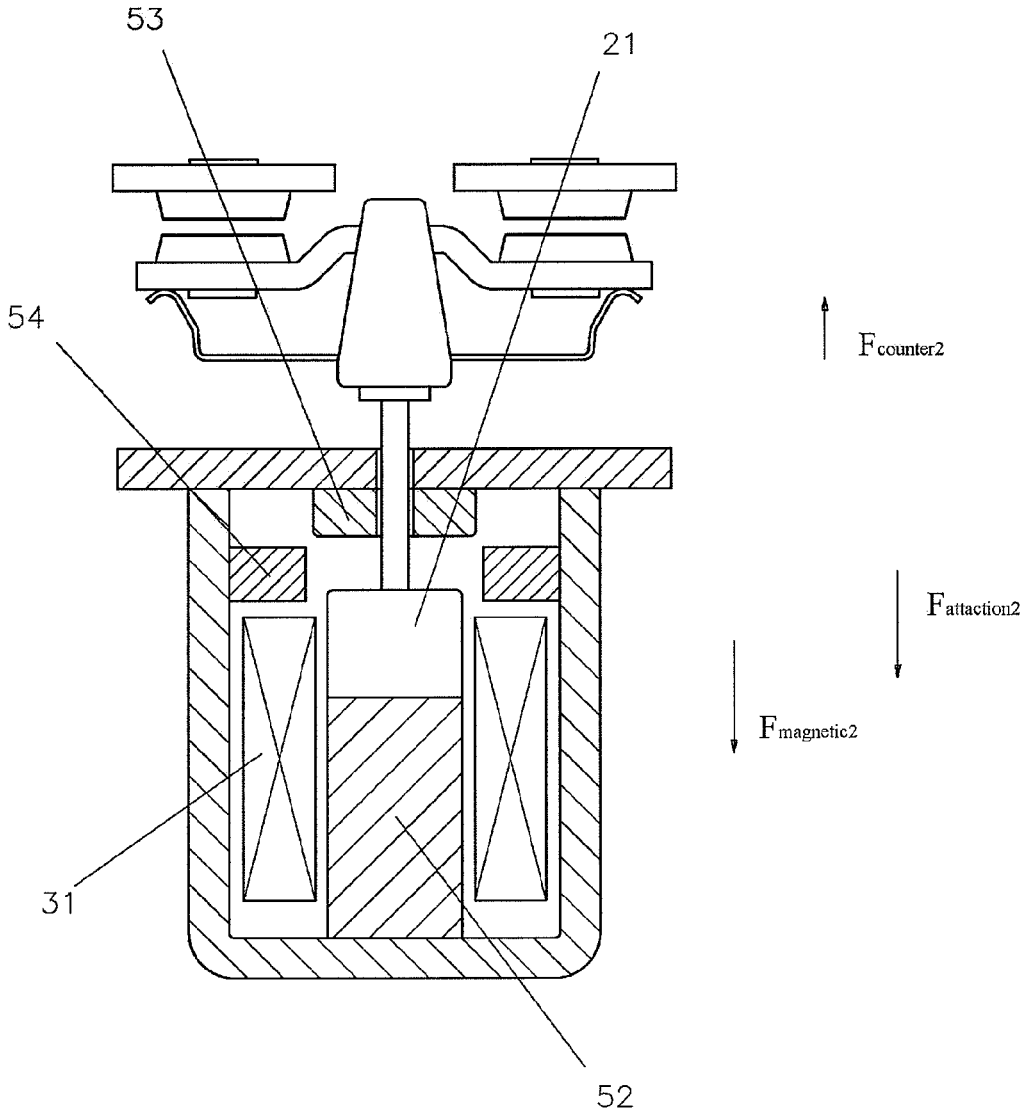
FIG. 5 is a schematic diagram showing a magnetic force, a coil attraction force and a counter force (in a contact opened state) of a magnetic latching relay having an asymmetrical solenoid structure according to an embodiment of the present disclosure.

In the magnetic latching relay having an asymmetrical solenoid structure according to an embodiment of the present disclosure, asymmetrical permanent magnets 54 are provided in the relay having an asymmetrical solenoid structure, such that the relay becomes a magnetic latching relay. As shown in FIGS. 4 and 5, the permanent magnets 54 are disposed asymmetrically, such that the relay can generate unbalanced magnetic forces in the actuating direction and in the opening direction. Since the permanent magnets 54 are closer to the second fixed iron core 53 in the direction of the axis of the coil 31, the magnetic force $F_{magnetic1}$ generated in the closed position is generally larger than the magnetic force $F_{magnetic2}$ generated in the opened position. Of the above mentioned unbalanced counter forces, the counter force $F_{counter1}$ in the closed state is also larger than the counter force $F_{counter2}$ in the opened state. Since the retaining force$=F_{magnetic}-F_{counter}$, it is ensured that the retaining forces keep balanced in the actuation process and in the reset process.

Figure 6:
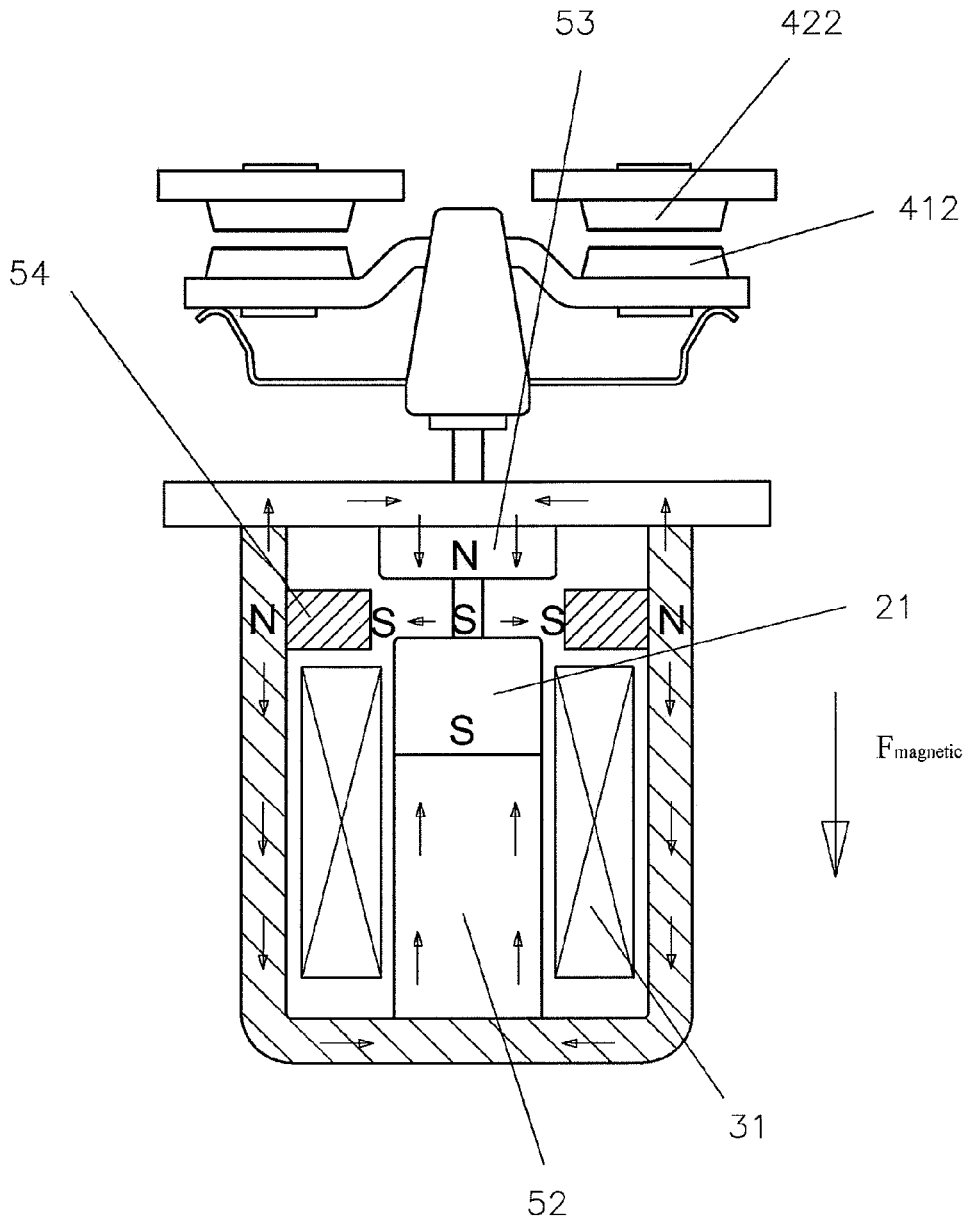
FIG. 6 is a schematic diagram showing a contact opened state of a magnetic latching relay having an asymmetrical solenoid structure according to an embodiment of the present disclosure.
Figure 7:
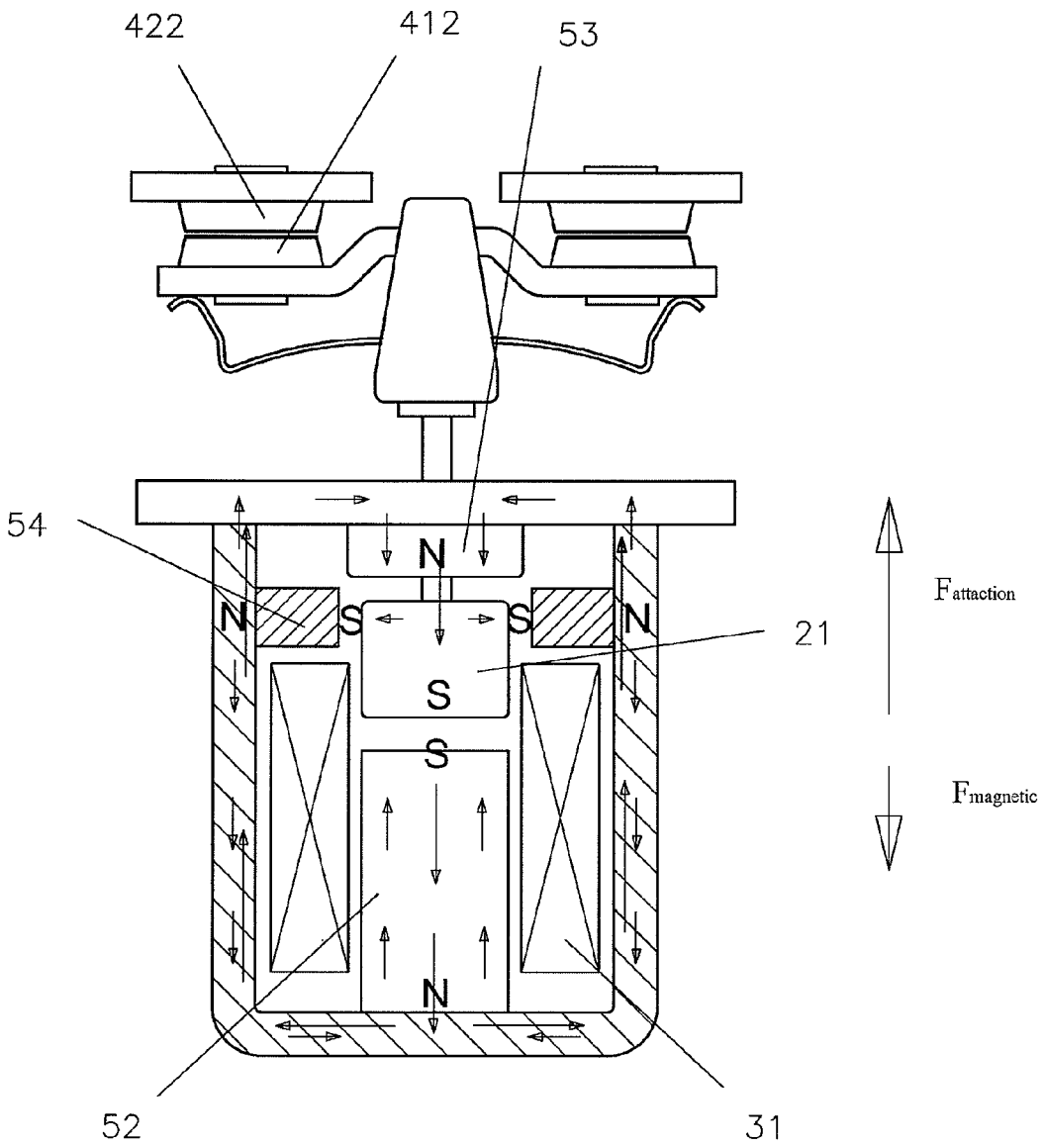
FIG. 7 is a schematic diagram showing a contact closing process of a magnetic latching relay having an asymmetrical solenoid structure according to an embodiment of the present disclosure.
Figure 8:
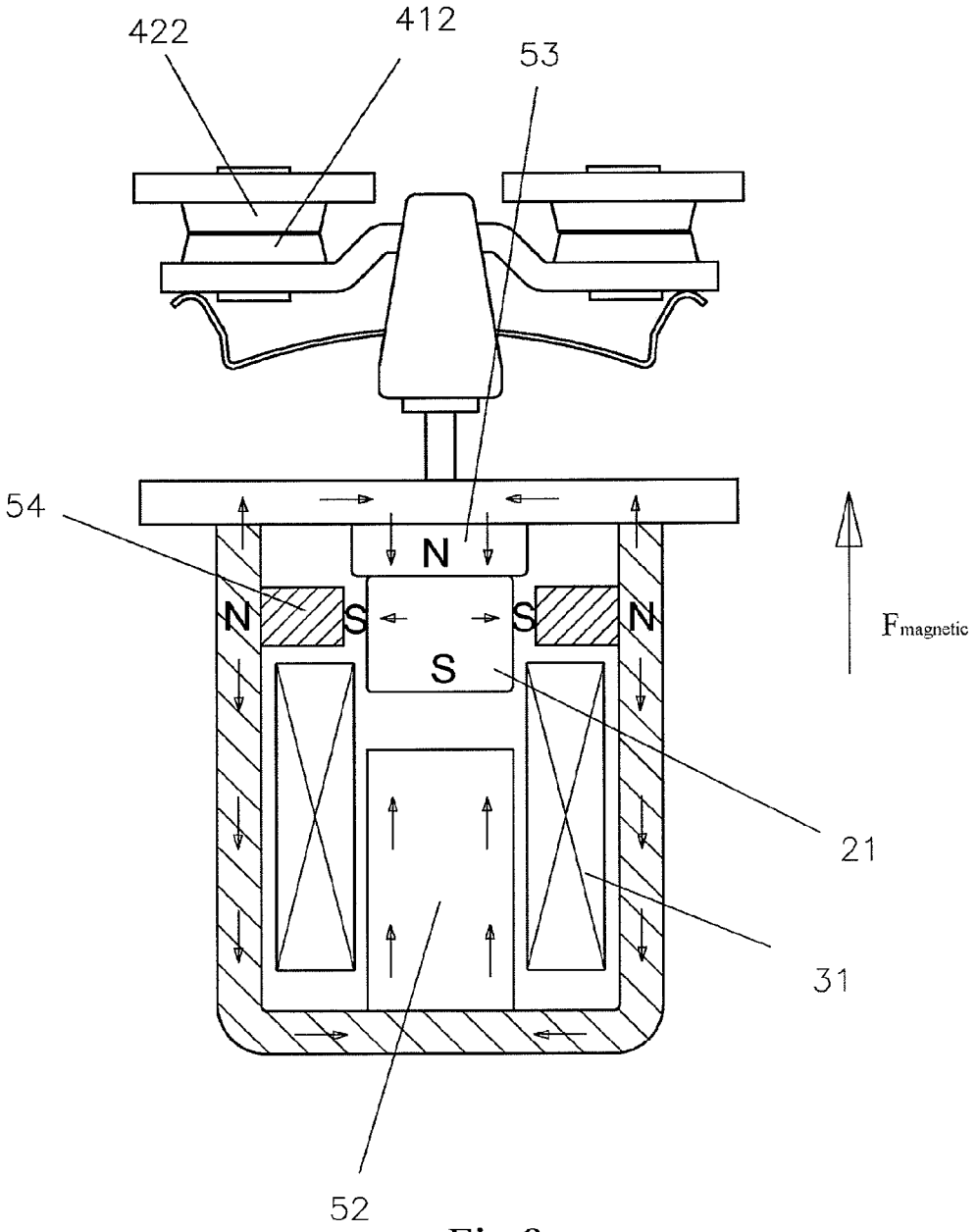
FIG. 8 is a schematic diagram showing a contact closed state of a magnetic latching relay having an asymmetrical solenoid structure according to an embodiment of the present disclosure.
Figure 9:
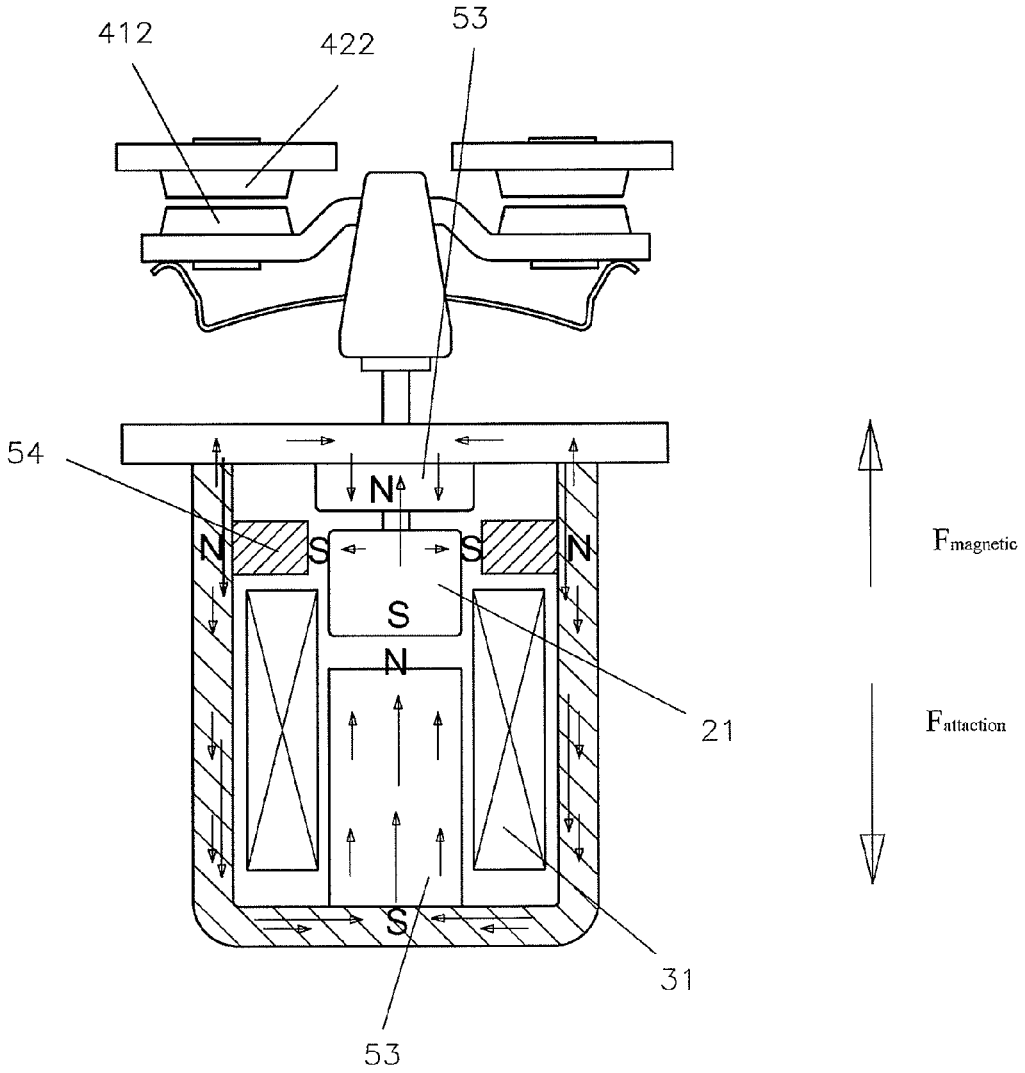
FIG. 9 is a schematic diagram showing a contact opening process of a magnetic latching relay having an asymmetrical solenoid structure according to an embodiment of the present disclosure.

Hereinafter, the magnetic latching relay having an asymmetrical solenoid structure according to an embodiment of the present disclosure is further described with reference to FIGS. 6 to 9. In the opened state (as shown in FIG. 6), under the magnetic force of the permanent magnet, the movable iron core 21 contacts with the first fixed iron core 52. In the closing process (as shown in FIG. 7), a voltage is applied to the coil 31 of the relay, and an upward attraction force of the coil is generated, the upward attraction force of the coil is larger than a downward magnetic force of the permanent magnet. Accordingly, the movable iron core 21 moves upward. The downward magnetic force of the permanent magnets gradually decrease as the air gap becomes larger. When the movable iron core 21 moves to close to an air gap of a median size, an upward magnetic force of the permanent magnets 54 becomes greater than the downward magnetic force until the relay is closed. In the closed state (as shown in FIG. 8), the two pieces of permanent magnets 54 provide an upward magnetic force. After the voltage applied to the coil 31 of the relay is removed, the relay can remain in the closed state under the magnetic force of the permanent magnets 54. In the opening process (as shown in FIG. 9), when the coil 31 of the relay is subject to a reverse driving voltage, the movable iron core 21 of the relay moves downward under an attraction force (downward) generated by the coil 31. The upward magnetic force generated by the permanent magnets 54 gradually decrease as the air gap becomes larger. When the movable iron core 21 moves to close to an air gap of a median size, a downward magnetic force generated by the permanent magnets 54 becomes greater than the upward magnetic force until the relay is opened. After the driving voltage is removed, the relay can remain in the opened state under the downward magnetic force of the permanent magnets 54 (as shown in FIG. 6).

The above permanent magnets 54 are placed closer to the second fixed iron core 53, such that the electromagnet portion formed by the permanent magnets 54, the yoke plate 512 and the second fixed iron core 53 is shorter than the electromagnet portion formed by the permanent magnets 54, the U-shaped yoke 511 and the first fixed iron core 52, thus the magnetic force (attraction force) generated by the permanent magnets 54 in the upper circuit is larger than the magnetic force (attraction force) generated by the permanent magnets 54 in lower circuit, and thereby the magnetic force (retaining force) generated in the closed state is larger than the magnetic force (retaining force) generated in the opened state.

In such a solenoid circuit, since the movable iron core 21 is connected to the push rod 22, the upper electromagnet portion generally has a smaller contacting area than that of the lower electromagnet portion. Further, taken the gravity force of the movable iron core 21 into consideration, the attraction force generated by the coil in the closing process is required to be larger than that in the opening process. When the permanent magnets 54 are placed bias to the upper electromagnet portion as described above, the magnetic force generated by the permanent magnets 54 is larger in the upper circuit than in the lower circuit, such that the attraction force generated by the coil 31 can be compensated.

The above embodiments are merely for illustration of the magnetic latching relay having an asymmetrical solenoid structure according to the present disclosure. However, the present disclosure is not limited thereto. Any simple change, equivalent alteration and modification to the above embodiment in accordance with the technical essence of the present disclosure all belong to the protective scope of the technical solution of the present disclosure.

What is claimed is:

1. A magnetic latching relay having an asymmetrical solenoid structure, comprising an electromagnet portion, a contacting portion, and a push portion; the push portion being fitted between the electromagnet portion and the contacting portion; the push portion comprising a movable iron core; the electromagnet portion comprising a magnetic conductive component and a coil; the movable iron core being disposed to be fitted with the magnetic conductive component and movable along a direction of an axis of the coil upon excitation of the coil, wherein the magnetic latching relay further comprises two pieces of permanent magnet, the two pieces of permanent magnets being respectively disposed on two sides of the axis of the coil and being respectively adjacent to or in contact with corresponding sides of the magnetic conductive component; and the two pieces of permanent magnets being within a movement range of the movable iron core in the direction of the axis of the coil, and being biased toward a side of a moving direction of the movable iron core when contacts are in a closed state such that a retaining force of the movable iron core in the closed state of the contacts is substantially equal to a retaining force of the movable iron core in an opened state of the contacts, wherein the magnetic conductive component comprises a yoke component, and a first fixed iron core; the movable iron core is disposed to be fitted with the first fixed iron core; and the two pieces of permanent magnets are respectively disposed on the two sides of the axis of the coil and are respectively adjacent to or in contact with corresponding sides of the yoke component, and the magnetic conductive component further comprises a second fixed iron core disposed on the axis of the coil and on the side of the moving direction of the movable iron core when the contacts are in the closed state; the movable iron core is disposed between the first fixed iron core and the second fixed iron core; and the two pieces of permanent magnets are disposed at a position between the first fixed iron core and the second fixed iron core where is closer to the second fixed iron core in the direction of the axis of the coil.

2. The magnetic latching relay having an asymmetrical solenoid structure according to claim 1, wherein the first fixed iron core has a length greater than a length of the second fixed iron core.

3. The magnetic latching relay having an asymmetrical solenoid structure according to claim 1, wherein the second fixed iron core has a cross sectional range greater than a cross sectional range of the movable iron core.

4. The magnetic latching relay having an asymmetrical solenoid structure according to claim 1, wherein the yoke component is in a frame shape, and the coil, the permanent magnet, the first fixed iron core and the second fixed iron core are respectively accommodated in the yoke component of the frame shape.

5. The magnetic latching relay having an asymmetrical solenoid structure according to claim 1, wherein the push portion further comprises a push rod and a holder, the contacting portion has a movable spring portion, and the movable spring portion is mounted on the holder, one end of the push rod passes through the yoke component and the second fixed iron core to be fixed with the movable iron core, and the other end of the push rod is connected to the holder.

6. The magnetic latching relay having an asymmetrical solenoid structure according to claim 5, wherein the movable spring portion has a movable spring leaf, and a boss for supporting the movable spring leaf and a compression spring is disposed on the holder, such that the movable spring leaf is supported through a preload of the compression spring and is allowed to be displaced and produce an over stroke in the direction of the axis of the coil.

* * * * *